US005433628A

United States Patent [19]

Sadaishi et al.

[11] Patent Number: 5,433,628

[45] Date of Patent: Jul. 18, 1995

[54] SEALING MECHANISM FOR CONNECTOR AND METHOD OF PRODUCING THE SAME

[75] Inventors: Keiko Sadaishi; Kazuhiro Morishita; Toshiaki Hasegawa, all of Shizuoka, Japan

[73] Assignee: Yazaki Corporation, Tokyo, Japan

[21] Appl. No.: 90,454

[22] Filed: Jul. 13, 1993

[30] Foreign Application Priority Data

Jul. 13, 1992 [JP] Japan ..... 4-185198
Aug. 28, 1992 [JP] Japan ..... 4-229916

[51] Int. Cl.[6] ..... H01R 13/405

[52] U.S. Cl. ..... 439/736; 29/883; 439/936

[58] Field of Search ..... 439/736, 936; 29/883

[56] References Cited

U.S. PATENT DOCUMENTS 3,522,575 8/1970 Watson et al. ..... 439/736 X
3,770,878 11/1973 Dozier ..... 439/736 X
4,029,388 6/1977 Knoll ..... 439/736

*Primary Examiner*—Eugene F. Desmond
*Attorney, Agent, or Firm*—Sughrue, Mion, Zinn, Macpeak & Seas

[57] ABSTRACT

A sealing mechanism for a connector and a method of producing a connector wherein undesirable invasion of water and oil from terminals in an earth connector, an engine connector or the like can reliably be prevented. A sealing mechanism for a connector is constructed such that a plurality of transversely extending grooves are formed on the opposite surfaces of an embedding portion of a terminal extending outside of a wall portion of a connector housing 1, and the connector housing and the terminal are molded integral with each other in the presence of a sealable coating agent applied to the embedding portion. A method of producing a connector is practiced by way of the steps of applying a sealable coating agent to an embedding portion of a terminal extending from a connector housing, and Subsequently, molding the connector housing integral with the terminal in the presence of the sealable coating agent applied to the embedding portion.

3 Claims, 4 Drawing Sheets

SEALING MECHANISM FOR CONNECTOR AND METHOD OF PRODUCING THE SAME

BACKGROUND OF THE INVENTION

The present invention relates to a sealing mechanism for a ground connector, an engine connector or the like wherein undesirable invasion of water and oil from terminals can reliably be prevented. Further, the present invention relates to a method of producing a connector wherein a sealing mechanism of the foregoing type is employed for practicing the method.

FIG. 7 shows by way of sectional view the structure of a conventional ground connector sealing mechanism.

Specifically, the ground connector sealing mechanism is constructed such that a female connector housing 21 includes a joint ground terminal 22, an opposing male connector housing 23 includes a female terminal 25 adapted to be connected to a tab-shaped joint terminal 24, and grease 27 is filled in the male connector housing 23 so as to prevent water from invading in the male connector 26 and the female connector 28.

With this construction, however, the grease 27 is molten by the heat generated by electrical connection between both the terminals 24 and 25, causing the water-proof property of the ground connector sealing mechanism to be degraded. In this case, there arises a malfunction that water invades in both the connectors 26 and 28 through a gap in an embedded portion 30 of a ground terminal 29.

FIG. 8 shows by way of sectional view the structure of another conventional engine connector sealing mechanism.

Specifically, the engine connector sealing mechanism is constructed such that an epoxy resin 54 is filled in the interior of a female connector 53 to be fixedly connected to a connection hole 52 formed through an engine block 51, so as to prevent engine oil from flowing up from the interior of the engine block 51 along a cable 55 extending from the interior of the engine block 51 to the female connector 53.

With the engine connector sealing mechanism constructed as shown in the drawing, the epoxy resin 54 is filled in the range extending from the inside of a rubber plug 56 fitted into the connector end to the base end of a female tab of a crimped cable terminal 57. In addition, an O-ring 58 is fitted into the connection hole 52 of the female connector 53 and a packing 60 is fitted into an opponent male connector 59 so as to prevent oil and water from invading in the female connector 53 and the male connector 59.

With this construction, however, there arise problems that an operation for filling the female connector 53 with the epoxy resin 54 is troublesome and time-consuming, and moreover, operator's hands are readily contaminated with the epoxy resin 54 during the filling operation.

SUMMARY OF THE INVENTION

The present invention has been made in consideration of the aforementioned background.

An object of the present invention is to provide a sealing mechanism for a connector wherein invasion of water from a terminal in an earth connector and invasion of oil in an engine connector can simply and reliably be prevented.

Another object of the present invention is to provide a method of producing a connector of the foregoing type.

According to one aspect of the present invention, there is provided a sealing mechanism for a connector having a terminal extending outside of a wall portion of a connector housing, wherein the sealing mechanism is characterized in that a plurality of transversely extending grooves are formed on the opposite surfaces of the terminal, and that the connector housing and the terminal are molded integral with each other in the presence of a sealable coating agent applied to the embedding portion of the terminal.

In addition, according to another aspect of the present invention, there is provided a method of producing a connector wherein a terminal extending outside of a connector housing is molded integral with the connector housing, wherein the method is characterized in that a sealable coating agent is applied to an embedding portion of the terminal, and that the connector housing and the terminal are molded integral with each other in the presence of the sealable coating agent applied to the terminal portion.

According to another aspect of the present invention, there is provided a method of producing a ground connector wherein an earth terminal is molded integral with a connector housing, wherein the method is characterized in that a sealable coating agent is applied to a junction portion of the ground terminal extending outside of the connector housing, and that the junction portion having the sealable coating agent applied thereto is molded integral with the connector housing.

In addition, according to another aspect of the present invention, there is provided a water-proofing mechanism for a ground connector having an earth terminal extending outside of a connector housing, wherein the waterproofing mechanism is characterized in that a plurality of transversely extending grooves are formed on the opposite surfaces of a junction portion of the ground terminal, and that the junction portion is molded integral with the connector housing in the presence of a sealable coating agent applied to the junction portion of the ground terminal.

In the presence of the sealable coating agent applied to the embedding portion, any gap does not appear between the embedding portion of the terminal and the connector housing, whereby undesirable invasion of water and oil from the outside can reliably be prevented. The transversely extending grooves formed on the embedding portion of the terminal contributes to improvement of the adhesiveness of the sealable coating agent to the embedding portion, resulting in the sealability of the connector housing and the terminal against invasion of water and oil being further improved. The application of the sealable coating agent to the embedding portion and the integral molding of the connector housing with the terminal can simply be achieved for a short time.

DETAILED DESCRIPTION OF THE PREFERRED EMBODIMENTS

Figure 1:
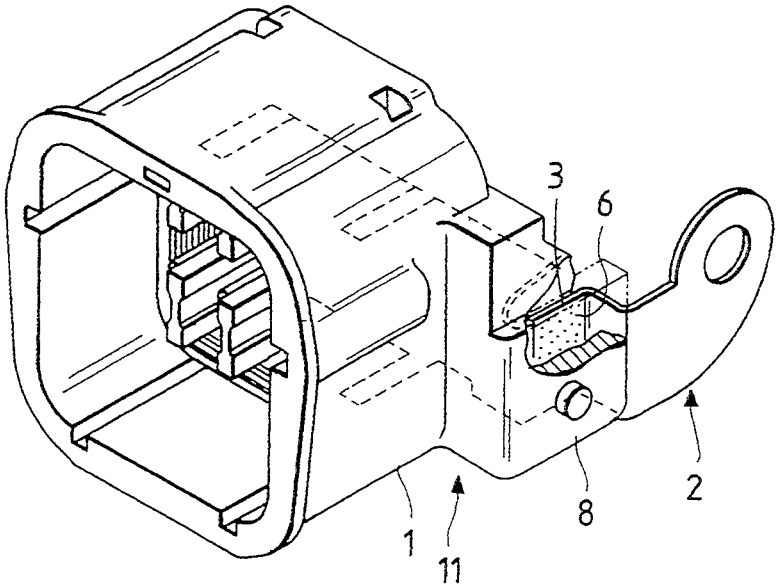
FIG. 1 is a partially exploded perspective view of a connector housing for which a connector sealing mechanism constructed according to a first embodiment of the present invention is employed.
Figure 2:
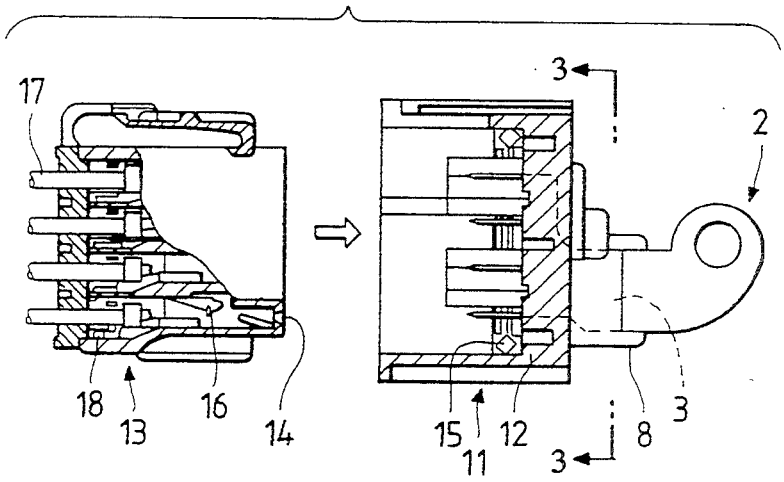
FIG. 2 is a vertical sectional view of the connector housing and an opponent connector, particularly showing the state of the connector housing and the opponent connector before the opponent connector is fitted into the connector housing.
Figure 3:
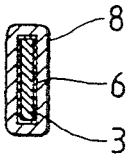
FIG. 3 is a fragmentary sectional view of the connector housing taken along line A—A in FIG. 2.

The present invention will now be described with reference to the accompanying drawings. FIG. 1 shows by way of example a ground connector for which a sealing mechanism constructed according to a first embodiment of the present invention is employed, FIG. 2 is a vertical sectional view of the ground connector and an opponent connector, particularly showing the state of both the connectors before the opponent connector is fitted into the ground connector, and FIG. 3 is a fragmentary sectional view of the ground connector taken along line A—A in FIG. 2.

With the sealing mechanism constructed as shown in the drawings, a ground terminal 2 extending from a female connector housing 1 molded of a synthetic resin includes an embedding portion 3 embedded in the female connector housing 1, and a sealable coating agent 6 applied to the embedding portion 3 of the terminal 2. While the embedding portion 3 of the ground terminal 2 is coated with the sealable coating agent 6, the female connector housing 1 and the ground terminal 2 are molded integrally with each other.

Figure 4:
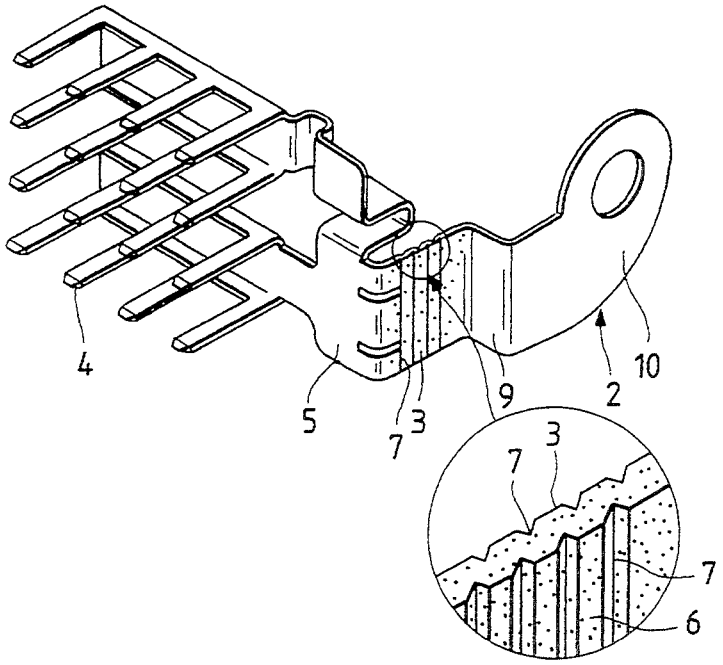
FIG. 4 is a perspective view of a joint ground terminal (wherein an essential part of the joint ground terminal is shown on an enlarged scale in a section defined by a circle).

As shown in FIG. 4, the ground terminal 2 is integral with a base portion 5 of a joint terminal 4 to be received in the female connector housing 1, and a plurality of transversely extending grooves 7 are formed on the opposite surfaces of the flat plate-shaped embedding portion 3 extending from the base portion 5 in the curved state at a right angle relative to the base portion 5 in order to improve the adhesiveness of the sealable coating agent 6 to the embedding portion 3.

The transverse extending grooves 7 are alternately formed on the opposite surfaces of the embedding portion 3. The fore end part of the embedding portion 3 is bent at a right angle relative to the embedding portion 3 and then projected outside of a wall portion 8 of the female connector housing 1 to form a bent part 9. Further, the fore end part of the bent part 9 is additionally bent at a right angle relative to the bent part 9 to form a ground connecting portion 10.

A silicone based adhesive (Cemedine LG-002 or the like) adapted to be coated over an opponent article by actuating a sprayer can be noted as a material preferably employable for the sealable coating agent 6.

As shown in FIG. 2, a seal packing 15 for receiving a fitting portion 14 at the foremost end of a male connector 13 is fitted to a bottom wall 12 of a female connector (ground connector ) 11, and a plurality of rubber plugs 18 each adapted to come in close contact with a cable 17 connected to a terminal 16 are arranged at the rear part of the male connector 13.

With such construction, once both the connectors 11 and 13 are connected to each other, the sealable coating agent 7 prevents water from invading in an assembly of both the connectors 11 and 13 from the ground terminal 2 side, the seal packing 15 prevents water from invading in the foregoing assembly from the fitting portion 14 side, and moreover, the rubber plugs 18 prevent water from invading in the male connector from the outside, whereby complete water-proof property is established for both the connectors 11 and 13.

Figure 5:
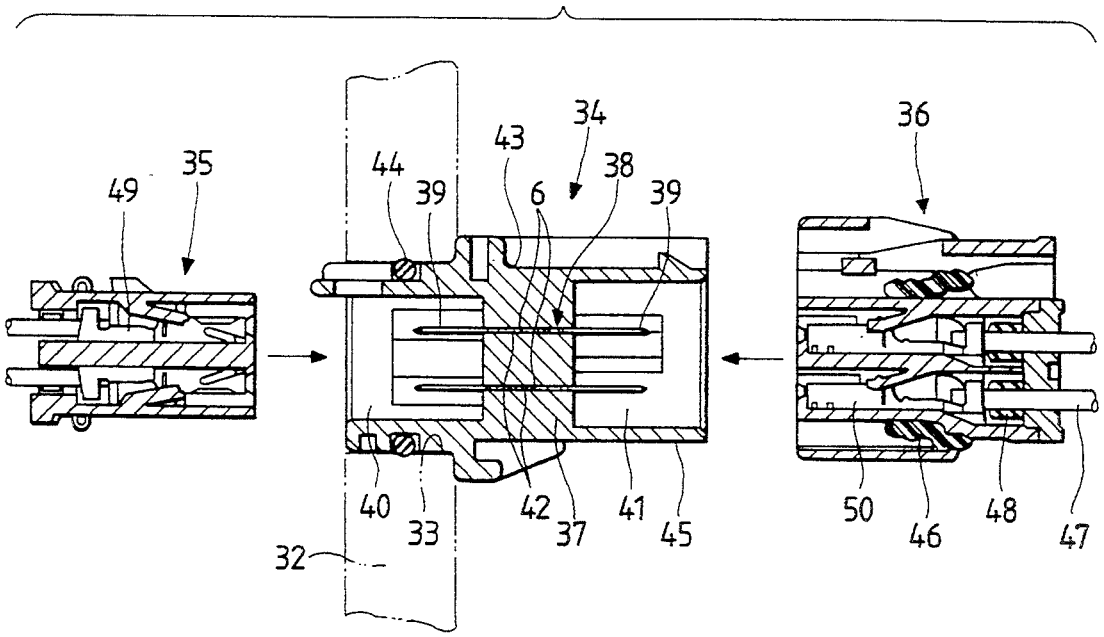
FIG. 5 is a vertical sectional view of a sealing mechanism for a connector constructed according to a second embodiment of the present invention, particularly showing inner and outer connectors and a relay connector in the disassembled state.
Figure 6:
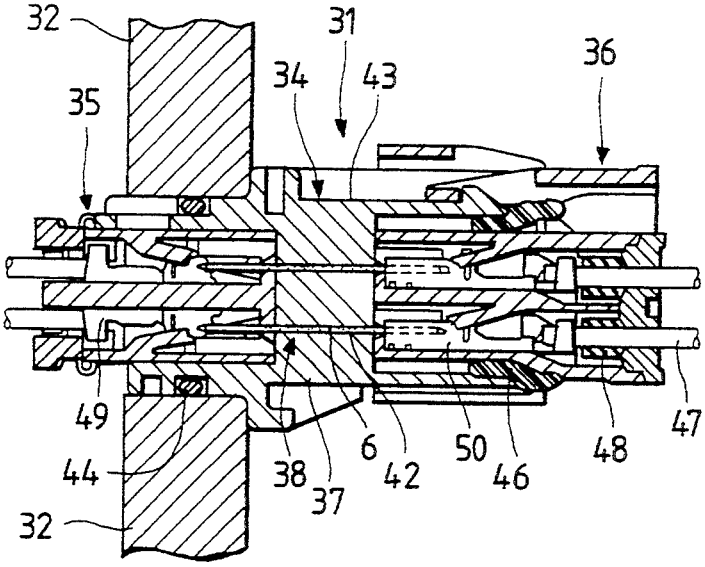
FIG. 6 is a vertical sectional view of the inner and outer connectors and the relay connector assembled together by employing the sealing mechanism.
Figure 7:
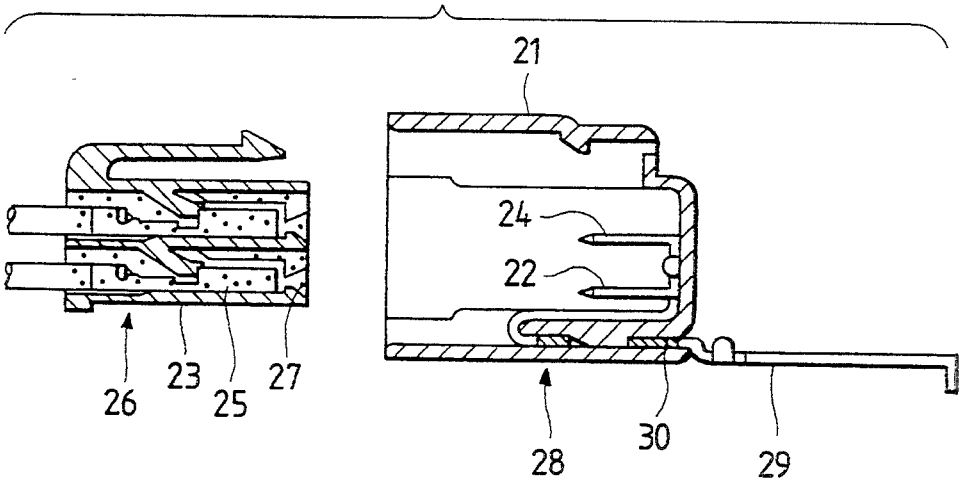
FIG. 7 is a vertical sectional view of male and female connectors for which a conventional sealing mechanism is employed, particularly showing both the male and female connectors in the disassembled state.
Figure 8:
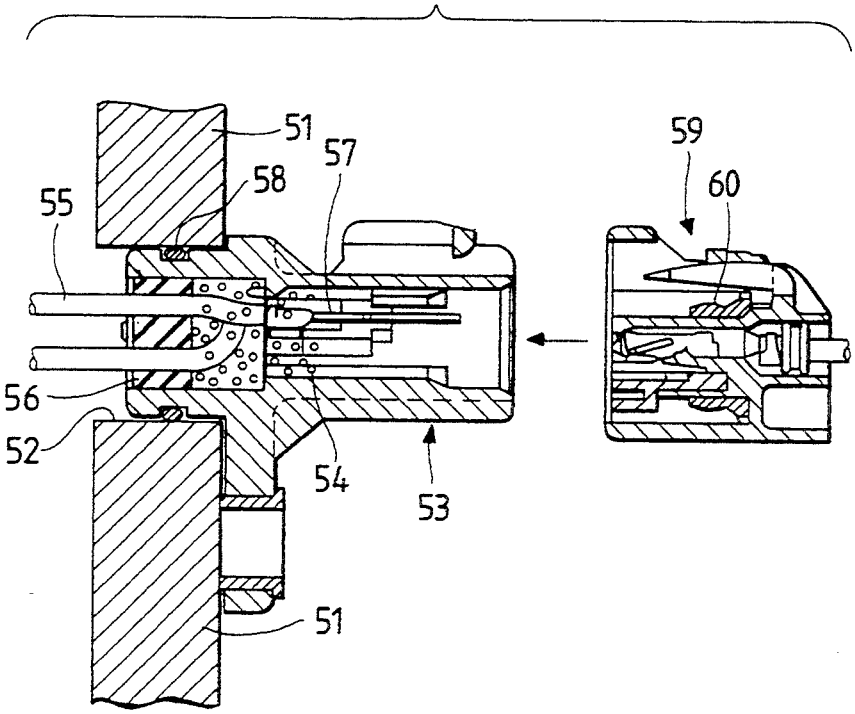
FIG. 8 is a vertical sectional view of male and female connectors for which another conventional sealing mechanism is employed, particularly showing both the male and female connectors in the disassembled state before the male connector is fitted onto the female connector.

FIG. 5 shows by way of disassembled vertical sectional view an example of an engine connector for which a sealing mechanism constructed according to a second embodiment of the present invention is employed, and FIG. 6 is a vertical sectional view of the engine connector, particularly showing the assembled state of the engine connector.

The engine connector designated by reference numeral 31 is composed of a relay connector 34 fixedly fitted to a connecting hole 33 formed through an engine block 32 by tightening bolts or the like (not shown), an inner connector 35 connected to the relay connector 34 from the inside of the engine block 32, and an outer connector 36 connected to the relay connector 34 from the outside of the engine block 32.

A plurality of straight plate-shaped relay terminals 38 are embedded in an intermediate wall portion 37 of the relay connector 34, and male tabs 39 on the opposite ends of each relay terminal 38 are projected inside of connector fitting chambers 40 and 41. A characterizing feature of the sealing mechanism of the present invention consists in that a sealable coating agent 6 similar to that in the preceding embodiment is applied to embedding portions 42 in the relay terminal 38, and subsequently, a connector housing 43 (inclusive of an intermediate wall portion 37) molded of a synthetic resin and the embedding portions 42 each coated with the sealable coating agent 6 are molded integral with each other.

The relay connector 34 includes an O-ring 44 fitted into the connecting hole 33 of the engine block 32, and the outer connector 36 includes a packing 46 for receiving a fitting portion 45 at the foremost end of the relay connector 36 and a plurality of rubber plugs 48 each coming in close contact with a cable 47. It should be noted that the inner connector 35 includes no sealing mechanism. The inner and outer connectors 35 and 36 include female terminals 49 and 50 to cooperate with the male tabs 39 on the relay terminal 38. Once the inner and outer connectors 35 and 36 and the relay connector 34 are connected to each other, various electrical connections are made inside and outside of an engine (not shown). The sealable coating adhesive 6 applied to the relay terminal 38 simultaneously prevents any outflow of oil from the interior of the engine as well as any invasion of water from the outside.

As is apparent from the above description, according to the present invention, since a connector housing and an embedding portion of a terminal are molded integral with each other in the presence of the sealable coating agent applied to the embedding portion, any invasion of water and oil can be prevented no matter how heat and vibration are applied to the connector housing. In contrast with the conventional sealing mechanism, since there is no need of performing an operation for filling the connector with grease and epoxy resin, a sealing mechanism for a connector can easily be constructed in a compact manner.

What is claimed is:

1. A sealing mechanism for a connector having a terminal extending through a wall portion of a connector housing in a first direction, characterized in that a plurality of grooves, extending in a second direction orthogonal to the first direction, are formed on opposite surfaces of an embedding portion of said terminal, and that said connector housing and said terminal are integrally molded with each other in the presence of a sealable coating agent applied to said embedding portion of said terminal, said grooves being formed across an entire length of said embedding portion and being of substantially equal width with grooves on one side being alternately disposed with respect to grooves on the opposite side, said length extending in said first direction.

2. A method of producing a connector wherein a terminal extending outside of a connector housing is molded integral with said connector housing, said method comprising the following steps of:

forming a plurality of grooves of substantially equal width in an embedding portion of said terminal across an entire length thereof with grooves on one side being substantially alternately disposed with respect to grooves on the opposite side; and applying a sealable coating agent to said embedding portion of said terminal; and molding said connector housing and said terminal integral with each other in the presence of said sealable coating agent applied to said embedding portion.

3. In a water-proofing mechanism for a ground connector having a ground terminal extending through a connector housing in a first direction, the improvement wherein a plurality of grooves extending in a second direction orthogonal to the first direction are formed on the opposite surfaces of a junction portion of said ground terminal where said ground terminal is joined to said housing, and that said junction portion is integrally molded with said connector housing in the presence of a sealable coating agent applied to said junction portion of said ground terminal, wherein said grooves are formed along an entire length of said junction portion and are of substantially equal width with grooves on one side being substantially alternately disposed with respect to grooves on the opposite side, said length extending in said first direction.

* * * * *